United States Patent [19]

Risman

[11] Patent Number: 4,743,725

[45] Date of Patent: May 10, 1988

[54] COAXIAL LINE MICROWAVE HEATING APPLICATOR WITH ASYMMETRICAL RADIATION PATTERN

[75] Inventor: Per O. G. Risman, Härryda, Sweden

[73] Assignee: Skandinavisk Torkteknik AB, Gothenburg, Sweden

[21] Appl. No.: 938,906

[22] Filed: Dec. 8, 1986

[30] Foreign Application Priority Data

Dec. 5, 1985 [SE] Sweden ..... 8505774

[51] Int. Cl.[4] ..... H01P 3/06; H05B 6/72

[52] U.S. Cl. ..... 219/10.55 F; 219/10.55 R; 166/60; 166/248; 299/14; 333/237; 343/770

[58] Field of Search ..... 219/10.55 R, 10.55 A, 219/10.55 F; 166/60, 248; 299/14; 333/237; 340/552, 553; 343/770

[56] References Cited

U.S. PATENT DOCUMENTS

| | | | |
|---|---|---|---|
| 4,300,338 | 11/1981 | Harman et al. | 333/237 |
| 4,339,733 | 7/1982 | Smith | 333/237 |
| 4,571,473 | 2/1986 | Wyslouzil et al. | 219/10.55 A |
| 4,620,593 | 11/1986 | Haagensen | 219/10.55 A |

FOREIGN PATENT DOCUMENTS

| | | | |
|---|---|---|---|
| 0077622 | 6/1977 | Japan | 333/237 |

*Primary Examiner*—M. H. Paschall
*Attorney, Agent, or Firm*—Holman & Stern

[57] ABSTRACT

A microwave heating applicator usable in preformed holes in mansonry and the like for heating and dehumidifying areas around the holes is formed from a length of coaxial transmission line. Radiating elements are formed in the outer conductor of the coaxial line for providing an asymmetrical radiation pattern. The radiating elements are provided by forming circumferential axial discontinuities in the outer conductor, each discontinunity having a pair of non-parallel cut edges formed in the outer conductor encircling the line, leaving an asymmetrical open area extending axially between the cut edges. One of the cut edges may describe a plane perpendicular to the coaxial line's z axis while the other cut edge describes a plane which is not perpendicular to the coaxial line z axis. The radiating elements may be provided at intervals along the coaxial line. An end radiating element may be formed having only one edge cut in the outer conductor, the element being bounded by the remote end of the coaxial line with the outer conductor removed therebetween. A flattened radiation pattern may be obtained by orienting adjacent radiating elements with their respective radiating asymmetries angularly rotated 180 degrees relative one another. The interval between radiating elements must be at least on the order of one-half wavelength in the antenna medium of the coaxial line. The applicator may be provided with a microwave-transparent outer protective cover.

6 Claims, 1 Drawing Sheet

COAXIAL LINE MICROWAVE HEATING APPLICATOR WITH ASYMMETRICAL RADIATION PATTERN

Figure 1:
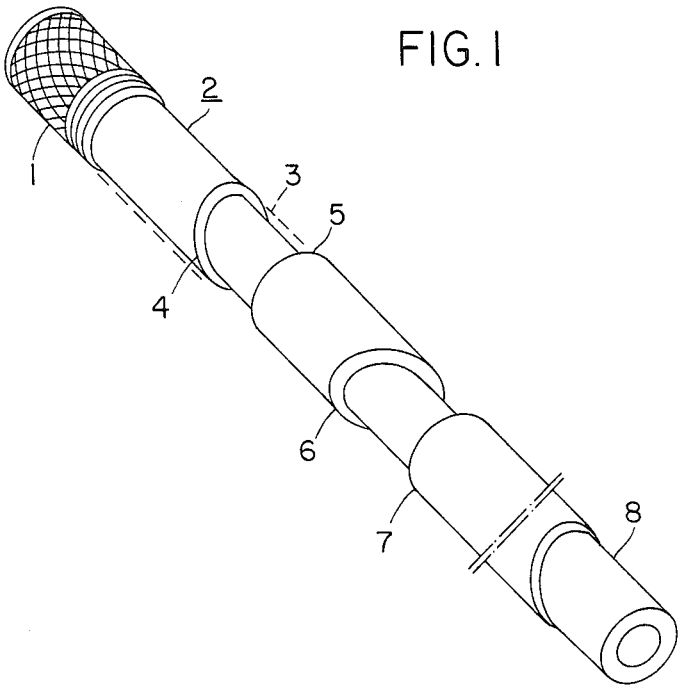

The present invention relates to systems for transmission and adaptation of microwave energy, so-called applicators, to be used in pre-drilled holes in damp masonry and the like, to heat and subsequently to dry out or expel moisture from the masonry along and around the hole.

Damages to masonry consisting of e.g. concrete, caused by moisture and damp is often a serious problem in both old and new buildings. As a rule, the water—which often carries dissolved salts—rises by capillary action. In principle, rising damp can be halted by introducing a horizontal surface barrier which is then made permanent. One method of creating such a barrier without having to break up the wall is to dry out at depth or expel moisture from a horizontal zone and before the moisture can begin to collect again to impregnate the masonry with a substance which blocks the capillaries permanently. Such a method is described in, for example, the Swedish Patent Application No. 8303878-6. Nothing is said there, however, as to how the microwave applicator should be designed to create the field pattern which will heat the masonry to achieve the desired effect.

An applicator to be used in the present geometry must provide as even heat distribution as possible in and along the entire hole. It need not be constant in the angular dimension ($\theta$, cylindrical coordinates); more heating left-right and less up-down could be desirable as efficiency will increase.

In practice, there are several generators with applicators in use simultaneously in a number of pre-drilled holes.

A prior art applicator type which might be considered is an ordinary TE 10 rectangular waveguide placed perpendicularly against the wall. However, when using the only practical/economical frequency of 2.45 GHz, initial wave energy penetration will be typically only 15 to 50 mm. This small penetration depth is mainly due to the ion and high water content. (Penetration depth is here defined as the depth below the surface at which the energy density is reduced to 1/e of the surface value.) The penetration depth increases when the moisture has evaporated or been expelled by the temperature gradient pressure, from the area having the highest field strength. Nevertheless, it would probably be impracticable to dry out to deeper than about 300 mm even after several hours of continuous power application. One reason for this limitation is that heat conductivity (which in principle causes efficiency degradation) increases as the total surface where there is a moisture and temperature gradient increases, thus reducing the gradient and thereby the expulsion of moisture. Another reason is that the moisture movement results in a higher moisture content in the zone outside the one where the moisture content has been lowered and that this high moisture content creates an opposite water pressure gradient.

Another prior art method is to insert an antenna rod being the inner conductor of a stripped coaxial line. However, as mentioned above, the initial microwave penetration depth in the wall material is only 15–50 mm. This results in steeply decreasing power density in axial direction (z). The radiating section is thus so short that the only improvement is that drying can be effected to perhaps a 50 mm greater depth than with an externally applied waveguide applicator. Moreover, in actual practice, the coaxial antenna length must be reduced to achieve good impedance matching and efficiency.

There is a significant improvement by increasing the coaxial line length and beginning the antenna section some distance away from the hole opening. Under favourable conditions. it may be possible to dry a 200 to 250 mm thick wall with an optimum applicator of this kind. In addition, an advantage of reduced microwave leakage towards the gnerator is achieved. However, the applicator provides an almost spherical heating pattern, which slows down and/or decreases dehumidification unless the holes are close and the wall is thin.

SUMMARY

The object of the invention is a so-called applicator for microwaves 2.45 GHz, to be used in pre-drilled holes in e.g. masonry in order to heat and subsequently dehumidify it.

The applicator has several radiating areas in the axial direction, eliminating uneven heating which would otherwise result due to the limited microwave energy penetration depth. Furthermore, radiation may be directed in vary angular directons, so that while several parallel holes are being treated simultaneoulsy, drying proceeds preferably in left-right directions thereby improving efficiency. The asymmetrical radiation pattern is emitted from openings in the outer conductor of a coaxial line. In the openings at least one section plane varies in its axial position in relation to the angular coordinate.

The present object of invention is an applicator which is coaxial and has several radiating areas which radiate asymmetrically in angular ($\theta$) direction. The coupling factors successively increase for the deeper radiating areas and the coupling to the coaxial line is of shunt type. The influence of varying moisture content of the surrounding material on power density is therefore relatively small. The final outer radiator can consist of an ordinary coaxial antenna of $\frac{1}{4}$ or $\frac{3}{4}$ wave type.

While heating is in progress, there will at first be a decrease in moisture content in some areas in the vicinity of the applicator. Diffraction and refraction phenomena will then occur in the boundary areas to moisture-rich surroundings. As the penetration depth is greater in drier material, the power density will decrease in such regions, so that a certain amont of leveling-out occurs by self regulation. It is thus not necessary that the applicator as such provides a fully even field distibution.

Figure 2:
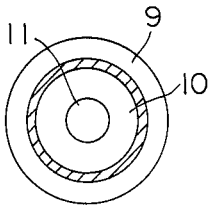

The invention is described in more detail in the following, with reference to the attached drawings, of which FIG. 1 shows the applicator in perspective with the external microwave transparent protective cover removed, and FIG. 2 shows a cross-section of the applicator in an area with an outer coaxial conductor.

The applicator is connected by a coaxial contacting device 1 to a corresponding device on the generator. The section at 2 is a continuation of the coaxial line and serves the purpose described above for the simple antenna. An asymmetrical discontinuity in the outer conductor is made at 3. The cut 4 can be made in several different ways; the simplest is to make it flat and sloping in relation to the axis at an angle of 25 to 65 degrees.

The corresponding cut at 5 can be perpendicular to the axis. The inner conductor is continuous. Most of the radiating energy is emitted from the area where cuts 4 and 5 are closes to each other. The open section at the following radiating area, 6 and 7 is somewhat larger, in order to compensate for the power reduction caused by emission from the preceding radiating area; the coupling factor is larger and the emitted power density is about the same from both radiating areas. The areas may be rotated 180 degrees in relation to each other, as is 6–7 and 4–5, to provide a "flattened" heating pattern in the $\theta$ direction. The distance between 5 and 6 must be at least in the order $\frac{1}{2}$ wavelength in the antenna medium, i.e. the dielectric of the coaxial line and its surrounding medium. At 2.45 GHz this distance is normally 30 to 40 mm. The choice of distance also depends on the total length of the applicator, i.e. the wall thickness it is intended for, and the microwave power imput for which it is designed. If the input power is low, the number of radiating areas can be reduced since heating is slower and heat conduction is a more important parameter. If the wall is thick, the number of radiating areas can also be reduced since power density will be lower for a given total input power. A typical number of radiating areas for a 400 mm thick wall and approximately 800 W microwave power is 4 to 5, including the end antenna section.

The diameter of the applicator is of course adjusted to the diameter found suitable for drilling the holes. Typically, the total diameter of the applicator is 15 to 20 mm. The outer cover is a microwave transparent tube 9, protecting against mechanical and chemical action. In common with the other microwave transparent parts of the system, it is preferably of PTFE. This material is chosen due to its excellent microwave properties, its high temperature tolerance, and good mechanical and chemical resistance. As the walls of the drill holes are heated to about 100 degrees C and heat conduction from the applicator is low, its intrinsic losses must be low. The inner conductor 11 must therefore have a very smooth surface and must, in practice, be silver-plated.

What is claimed is:

1. A microwave applicator means for the transmission and asymmetrical angularly and axially directed radiation of microwave energy input thereto, for use in preformed holes in masonry and the like for heating and dehumidifying areas around the holes, comprising:

a coaxial transmission line having an axial component z and including an inner conductor disposed at a position $r=0$ where r is the radial component of the coaxial transmission line, an outer conductor disposed concentrically around the inner conductor, and an electrical insulator of fixed dielectric value disposed between the inner and outer conductors; and radiating element means formed circumferentially in the coaxial line for radiating said microwave energy in an asymmetrical pattern with respect to the axial component z and the angular co-ordinate of the coaxial line, said radiating element means being in the form of a circumferential discontinuity having a diameter 2r cut in the outer conductor and defined by a pair of cut edges in the outer conductor which edges are non-parallel to one another, thereby forming an open circumferential area in the outer conductor between said pair of cut edges, the length of said open area along the z axis between said pair of cut edges varying with the angular co-ordinate of the coaxial line as a function having one maximum value and one minimum value.

2. A microwave applicator means according to claim 1, wherein the coaxial line is provided with at least two of said radiating element means formed circumferentially therein at axial intervals therealong with a minimum axial distance between the respective discontinuities of adjacent ones of said radiating element means being at least one-half the wavelength of said input microwave energy in the antenna medium of the coaxial line.

3. A microwave applicator means according to claim 2, wherein said input microwave energy has a frequency of 2.45 GHz and the minimum axial distance between the respective discontinuities of adjacent ones of said radiating element means is in the range of 30 to 40 millimeters.

4. A microwave applicator means according to claim 2 wherein at least one of said at least two radiating element means has one cut edge of said pair of cut edges thereof formed to define a plane perpendicular to the z axis such that the axial displacement of said first cut edge along the z axis as a function of the angular co-ordinate is equal to zero, with the other cut edge of said pair of cut edges thereof being formed to define a plane which is not perpendicular to the z axis such that the displacement of said other cut edge along the z axis as a function of the angular co-ordinate $\theta$ is equal to $k\sin\theta$ where k/r is in the range from 0.5 to 2.

5. A microwave applicator means according to claim 2 further comprising an end radiating element means formed at an outer end of the coaxial line opposite an input end thereof, said end radiating element means being formed with a cut edge in the outer conductor defining an open circumferential area in the outer conductor extending from said cut edge to said outer end.

6. A microwave applicator means according to claim 2 wherein adjacent ones of said at least two radiating element means are oriented relative one another such that the respective minimum axial lengths of said open areas thereof are rotated angularly 180 degrees from one another with respect to the angular co-ordinate.

* * * * *